United States Patent [19]

Kasamura et al.

[11] Patent Number: 4,611,899

[45] Date of Patent: Sep. 16, 1986

[54] DEVELOPING APPARATUS

[75] Inventors: Toshirou Kasamura, Yokohama; Nobukazu Sasaki, Tokyo, both of Japan

[73] Assignee: Canon Kabushiki Kaisha, Tokyo, Japan

[21] Appl. No.: 567,499

[22] Filed: Jan. 3, 1984

[30] Foreign Application Priority Data

Jan. 8, 1983 [JP] Japan ..... 58-1562
Jan. 8, 1983 [JP] Japan ..... 58-1565
Jan. 8, 1983 [JP] Japan ..... 58-1568

[51] Int. Cl.[4] ..... G03G 15/00

[52] U.S. Cl. ..... 355/3 DD; 355/4; 355/3 R

[58] Field of Search ..... 355/3 DD, 3 R, 4; 222/365, DIG. 1; 361/354; 307/147

[56] References Cited

U.S. PATENT DOCUMENTS 3,142,002 7/1964 Hammerly ..... 361/354
3,146,379 8/1964 Giger, Jr. ..... 361/354
3,229,166 1/1966 Edmunds ..... 361/354
4,095,879 6/1978 Katayama et al. ..... 354/4
4,272,689 6/1981 Crosby et al. ..... 307/147

*Primary Examiner*—Arthur T. Grimley
*Assistant Examiner*—David S. Warren
*Attorney, Agent, or Firm*—Fitzpatrick, Cella Harper & Scinto

[57] ABSTRACT

A developing apparatus loadable with a selected one kind of various kinds of developer container which contain different colors of the developers, respectively. Each of the developer container has a color-discriminating projection representative of the color of the developer contained therein. The developing apparatus includes a developer container receptacle which receives the developer container and a developer container preventing portion for preventing the insertion of the developer container if the color-discriminating projection of the developer container is in abutment therewith. The projection is divided into plural portions which correspond to the respective colors of the developer and which are selectively releasable.

14 Claims, 15 Drawing Figures

DEVELOPING APPARATUS

BACKGROUND OF THE INVENTION

1. Field of the Invention:

The present invention relates to a developing apparatus in which a selected developer container of the desired color is detachably mounted.

2. Description of the Prior Art:

In the conventional image formation systems such as electrophotographic systems, electrostatic recording systems and others, it is usual that the development apparatus utilizes a black-colored developer. Recently, it has been broadly required to form an image using variously colored developers other than the black-colored developer singly or in combination. For this purpose, a plurality of developing devices containing developers of different colors are provided, each of which is mountable into the image formation system to obtain an image of the desired image color. Or, the developing devices are selectively mounted in the same image formation system to form a superposed image in any desired color.

Where the developer in a developing device has been substantially fully consumed, this developing device must be subjected to the re-supply of the developer. In the prior art, the re-supply of the developer was carried out by inserting a cartridge-style developer container into the development device. If a plurality of containers containing differently colored developers are used, however, it is probable that the developing device will at some time be loaded with the wrong developer container, that is, the container having a different color developer, so that an image in an unwanted color will be formed. In addition, the original and re-supplied developers will be mixed with each other, which requires disassembling and cleaning of the whole development system in order to use the same again in good order. The prior art developing systems have no means for overcoming such a problem.

SUMMARY OF THE INVENTION

It is an object of the present invention to overcome the above disadvantages in the prior art and to make it certain that a developer container of the right color containing the same colored developer as the original color will be mounted to a developing device.

Another object of the present invention is to provide a development device in which a developer container of the right color can positively and easily be mounted.

Still another object of the present invention is to provide a developing apparatus which can be made to meet and properly engage with only one kind of the developer containers among the containers which contain developers of various colors.

Other objects and features of the present invention will be apparent from reading the following detailed description.

DESCRIPTION OF THE PREFERRED EMBODIMENTS

Figure 1:
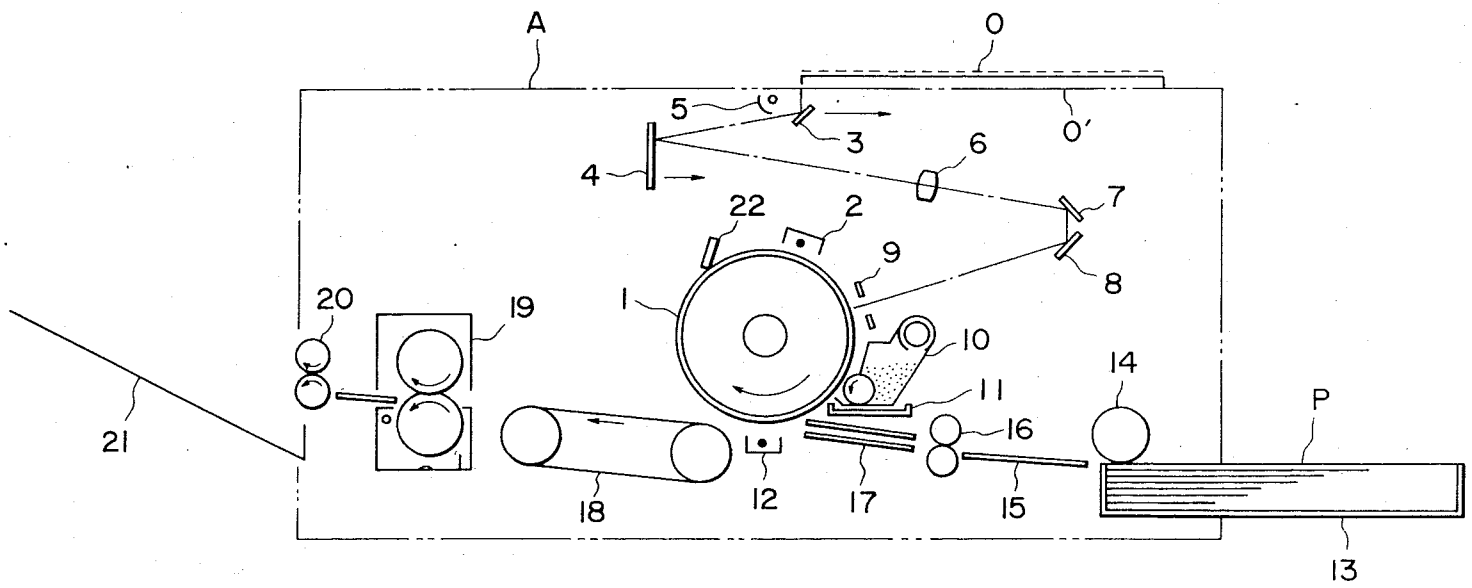
FIG. 1 is a diagrammatic view showing one example of electrophotographic systems.

FIG. 1 is a diagrammatic view showing an electrophotographic system usable as an image formation system to which the developing device according to the present invention can be applied.

In FIG. 1, the system comprises a photo-sensitive drum 1 having an electrophotographic type photosensitive member mounted thereon around the outer periphery and which can be rotated in the direction of arrow. As the drum 1 is rotated, it is first uniformly charged by means of a corona discharger 2 and then exposed to the light image of an original O to be copied through a slit 9 to form an electrostatic latent image corresponding to the original O on the drum 1.

The original O is placed on a carriage of glass O' and scanned by scanning mirrors 3 and 4 which are moved in the direction of arrow at a speed ratio of $1:\frac{1}{2}$. At the same time, an illuminator 5 is moved integrally with the mirror 3 to illuminate the original. The original O scanned in this manner is imaged through a lens 6 with the imaging beam being reflected by stationary mirrors 7 and 8 and then incident on the drum 1 through said slit 9.

Said latent image is developed at a developing device 10 to form a developed image. The developing device 10 is detachably mounted in the system body A by sliding it along a guide rail 11. Thus, the developing device may be replaced by another new developing device containing a developer of the desired color. The developing device is described in more detail below.

The developed image is then transferred to a sheet of paper P under the action of a transfer charger 12. This paper P has been fed out from a supply cassette 13 by a feed roller 14 one sheet at a time. The paper is guided to timing rollers 16 along a guide plate 15. Timed with the scanning of the original, the paper P is moved to a transfer station whereat the above transfer step is effected, by means of the timing rollers 16 along guide plates 17. After the transfer step, the paper P is separated from the drum 1 and moved to a fixing device 19 by means of a conveyor belt 18. As the paper P is being moved through the nip between fixing rollers, the developer on the paper P is dissolved by the heat so that the image will be fixed to the paper P. After the fixing step, the paper P is dicharged into a paper receiving tray 21 by discharge rollers 20 which are rotated in the direction of arrow to move the paper outwardly through the nip between the discharge rollers 20.

The developer remaining on the drum 1 after the transfer step is removed by a cleaner 22. Then, the drum 1 may be used again to execute the same image formation process.

The portion of the developing device into which a developer container is to be inserted will be described with reference to FIGS. 2A and 2B.

Figure 2A:
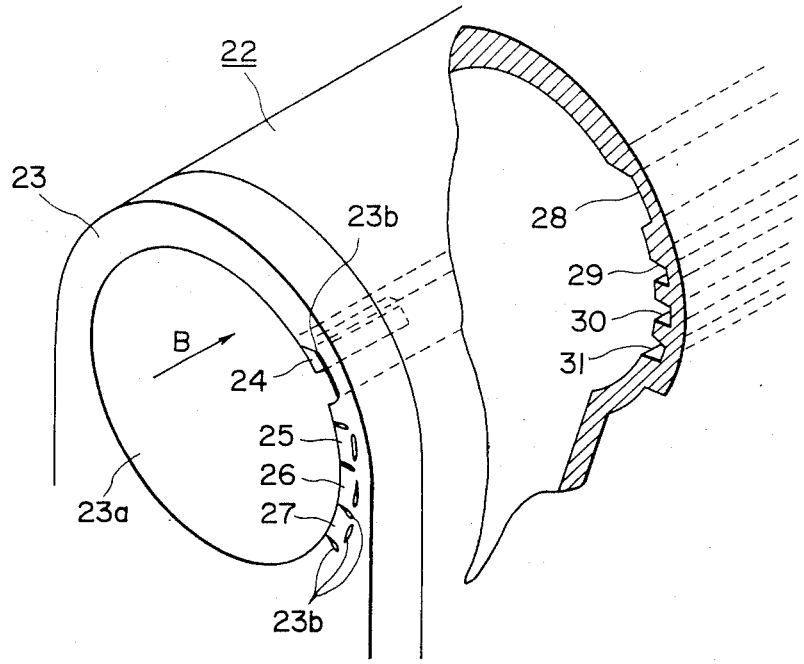
FIGS. 2A and 2B are perspective views showing the portion according to a developing device of the present invention into which a developer cartridge is inserted.

Referring to FIG. 2A, there is shown herein a developer storage receptacle 22 (hereinafter called simply "developer receptacle") which is adapted to receive developer cartridge used as the developer container. The developer receptacle 22 supports a covering 23 having an opening 23*a* formed therein through which the developer cartridge is inserted into the developer receptacle 22. As shown, the covering 23 includes a notch 23*b* formed therein at the edge of the opening 23*a* and removable pawls 24, 25, 26 and 27 formed around the peripheral edge of the opening 23*a*. Each of these pawls is matched to a respective one of developers having different colors which are to be used in the system. For example, the pawl 24 corresponds to black; the pawl 25 to sepia; the pawl 26 to blue; and the pawl 27 to magenta.

The development receptacle 22 includes a plurality of longitudinal grooves 28, 29, 30 and 31 formed therein at the inner wall thereof, which grooves correspond to the respective removable pawls. Each of the pawls is located at the entrance of the corresponding groove. Each of the grooves serves as a guide which engages a protrusion on the corresponding developer cartridge and guiding the developer cartridge against rotation when the cartridge is inserted into the development receptacle 22.

The grooves 29, 30 and 31 need not be separated. In other words, the partition walls between the grooves 29 and 30 are between the grooves 30 and 31 may be omitted.

Figure 2B:
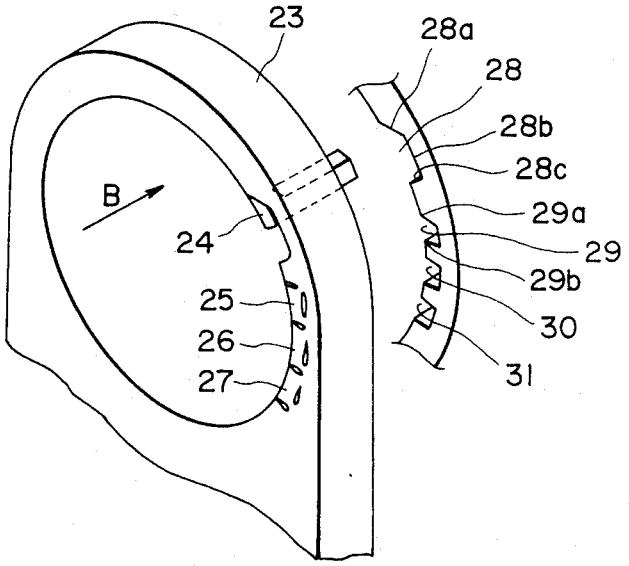

FIG. 2B is a perspective view showing the cover 23 removed from the developer receptacle 22 and part of the grooves formed in the developer receptacle 22.

As seen from FIG. 2B, the pawl 24 is elongated longitudinally of the developer receptacle and so disposed that the pawl 24 cannot easily be removed by a force given in a direction of arrow B (the direction of the cartridge insertion into the development receptacle) since the pawl 24 will contact either of the sides 28*a* or 28*b* of the groove 28 in the developer receptacle when a force is applied to the pawl 24 in the direction of arrow B. Each of the pawls 25, 26 and 27 on the covering 23 is of a width slightly larger than that of the corresponding groove 29, 30 or 31 on the developer receptacle. Therefore, if a force is applied to the pawl 25 in the direction of arrow B, it will contact the sides 29*a* and 29*b* of the groove 29 at the entrance thereof. Thus, the pawl 25 will not easily be removed by the force produced when the cartridge is to be inserted, as with pawl 24. This is also true of pawls 26 and 27.

The removable pawls 24–27 may be separated from the covering 23 by pulling them in the direction opposite to the direction in which the cartridge is inserted.

The number and configurations of the pawls and grooves may suitably be selected as required.

Figure 3:
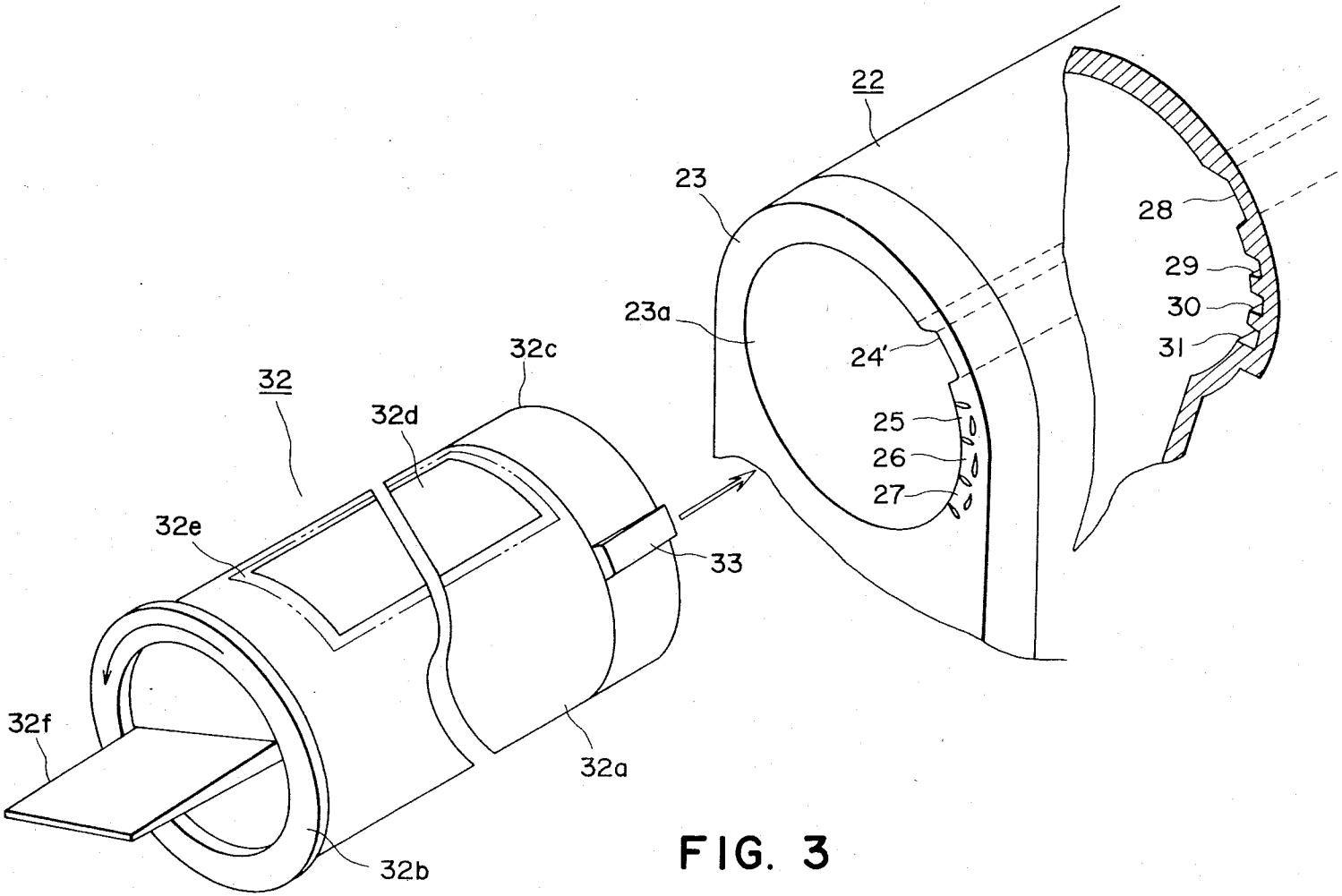
FIGS. 3 and 4 illustrate the engagement of the developer cartridge with the developing device.

FIG. 3 shows a state in which the covering 23 is mounted on the development receptacle after the pawl 24 has been removed from the covering 23. FIG. 3 illustrates a developer cartridge 32 having a cylindrical elongated containing portion 32*a* made of paper, plastics or other materials and containing a black-colored developer therein. The cylindrical container 32*a* includes flanges 32*b* and 32*c* of plastics material mounted thereon at the opposite ends. The flange 32*b* is of an outer diameter larger than that of the cylindrical container 32*a* and includes a knob 32*f* formed therein. The flange 32*c* includes a protrusion 33 formed thereon at the outer periphery thereof and which has its relatively large width. The cylindrical container portion 32*a* includes a longitudinally extending opening 32*d* formed therein such that it has a sufficient length to easily discharge the contained developer into a given developer supply port in the development device. The opening 32*d* is sealed by a sealing member 32*e*. Further, the flange 32*c* receives a cap (not shown) after the developer has been contained in the cylindrical container portion.

When the developer cartridge 32 is inserted into the developer receptacle 22, the protrusion 33 on the flange 32*c* engages the corresponding groove 28 on the developer receptacle 22. This becomes possible by the fact that the pawl 24 is removed from the covering 23 to form a passage 24' through which the cartridge 32 containing the black-colored developer can be inserted into the development receptacle 22.

Said protrusion 33 is used as a reference for positioning the developer cartridge 32 within the developer device when the developer cartridge 32 is inserted and rotated in apredetermined direction.

It is preferred that said opening 32*d* and an opening 34*d* which will be described hereinafter are disposed relative to said protrusion 33 and a protrusion 35 which will also be described hereinafter substantially at the same positional relationship with respect to the predetermined direction of rotation of the cartridge so that each of the openings in the cartridge will always be aligned with the given developer supply port in the developing device if any developer carriage is used in the development system.

Figure 4:
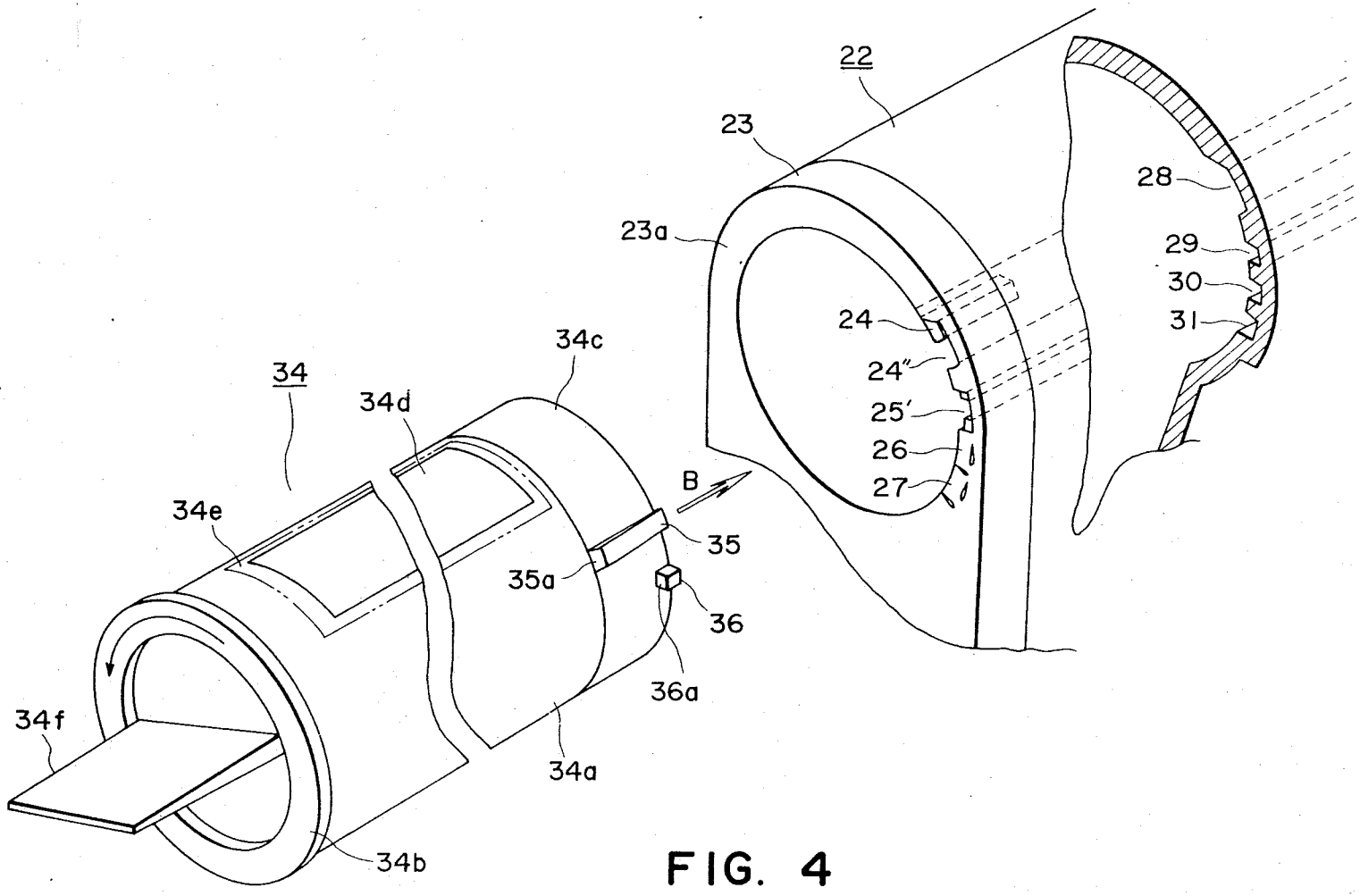

FIG. 4 is a perspective view showing such a condition that the pawl 25 is removed from the covering 23 without removing the pawl 24. The developer cartridge 34 is one that contains the developer of sepia color. This cartridge 34 includes two protrusions 35 and 36 formed on the rearward end flange 34*c* and spaced away from each other around the output periphery of the cartridge 34. The protrusion 35 is used as a reference protrusion for positioning the developer cartridge 34 within the development device 22 when the cartridge 34 is inserted into the developing device 22 and then rotated in the predetermined direction. The other protrusion 36 is used to discriminate the color of the developer contained in the selected developer cartridge 34. When the developer cartridge 34 is inserted into the developing device 22 with the opening 34*d* being faced up, the positioning and color-discriminating protrusions 35 and 36 are adapted to align with the recesses 24'' and 25' of the covering 23, respectively. These protrusions 35 and 36 also are adapted to align with the grooves 28 and 29 of the development device, respectively. The longitudinally extending pawl 24 facilitates the guidance of the protrusion 35 along the recess 24'' and the groove 28. The geometric arrangement of two protrusions 35 and 36 on the developer cartridge 34 is such that the protrusion 36 is changed in position relative to the longer reference protrusion 35 to engage in the groove 30 of the development receptacle for blue color and to engage in the groove 31 for magenta color. In this case, the pawl 26 or 27 will suitably be removed from the covering 23, corresponding to the developer cartridge to be used. In other words, a developer to be used will be determined by removing a pawl from the covering 23 in accordance with the desired color.

The engagement of the developer cartridge shown in FIGS. 3 or 4 with the developing device will be further considered. Even if one tries to insert the cartridge 32 of FIG. 3 into the developing device as shown in FIG. 4, this cartridge 32 cannot be inserted thereinto because the positioning and color-discriminating protrusion 33 having its width larger than that of the recess 24" engages the pawl 24. On the contrary, even if it is attempted to insert the cartridge 34 of FIG. 4 into the developing device shown in FIG. 3, this cartridge 34 cannot be inserted into that developing device since the protrusion 36 is engaged by the pawl 25. By the fact that each of the pawls may be used as means for preventing the insertion of the developer cartridge into the development device by causing the pawl to engage the corresponding protrusion on the developer cartridge, a developer cartridge will not be inserted into a wrong developing device for a different developer cartridge. Although a new developing device can be applied to any one of many developer cartridges, it can be applied only to a particular developer cartridge after any one of the aforementioned pawls has been removed from the developing device.

Thus, the combination of the selectively removed pawl of the developing device and the protrusion or protrusions provided on the developer cartridge enables only one kind of the cartridges to be inserted into the developing device.

If the number of the pawls in the covering 23 is increased with the corresponding grooves of the developer receptacle being increased in number, more kinds of developer cartridges containing different colors may be utilized.

Figure 5:
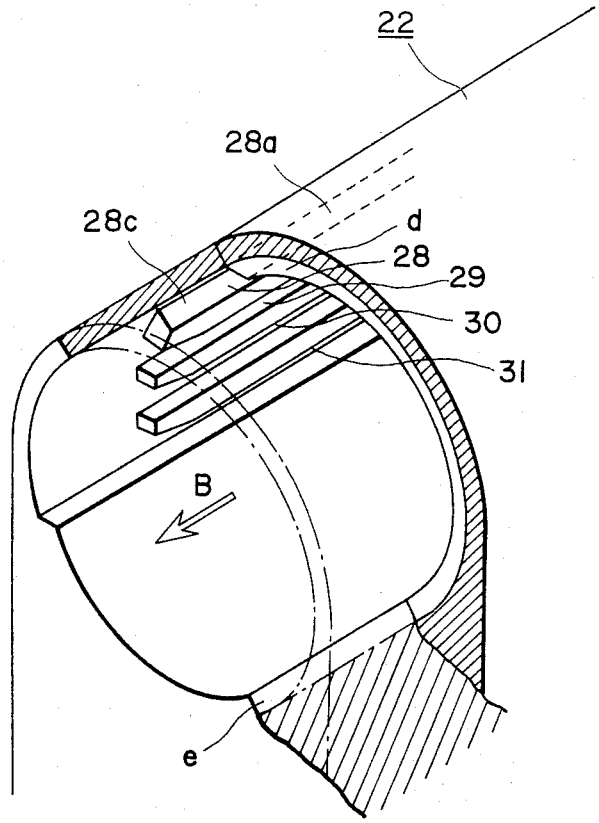
FIG. 5 is a partially broken out view showing the developer cartridge inserting portion of the developing device as backwardly viewed in FIGS. 2A and 2B.

FIG. 5 is a partially broken-away view of the cartridge receiving portion of the development receptacle 22 as viewed backwardly of the developing device. The groove 28 shown in FIG. 2 has its terminal end at which the opposite sides 28*a* and 28*c* of the groove 28 are positioned at different levels in the longitudinal direction of the development receptacle, that is, the direction B in which the cartridge is inserted into the developer receptacle, as shown in FIG. 5. Also, the side 28*c* is of a greater length than that of the other side 28*a* in the direction B. The opposite sides of each of the grooves 29, 30 and 31 is substantially of the same length as that of the side 28*c* of the groove 28. This is because after the cartridge has been inserted into the development device, the cartridge can be rotated to face the opening thereof downwardly so that the developer will by supplied from that cartridge to the developer receptacle. If the cartridge cannot be prevented from rotating by any color discriminating protrusion as shown by 36 which would be engaged by the above sides, it is not necessarily required that the length of each of the grooves 29, 30 and 31 is equal to that of the side 28*a* of the groove 28.

The side 28*c* of the groove 28 serves as a stopper surface adapted to engage the protrusion 35 on the cartridge such that the cartridge cannot be rotated rightwardly with respect to the direction B, that is, counterclockwise as viewed in FIG. 5. A surface d serves as means for preventing the cartridge from being drawn out by engaging the end face 35*a* of the protrusion 35 when the cartridge is rotated in predetermined direction as described later. A surface e serves as a rotation limiting section or stopper surface for limiting the rotation of the cartridge up to about 180 degrees so as to positively align the opening 34*d* of the cartridge with the developer supply port (not shown) of the developer receptacle when the cartridge is rotated after it has been inserted into the developing device.

The cartridge 34 can detachably be mounted in the developing device as follows: The sealing member 34*e* is gripped with the opening 34*d* of the cartridge 34 faced up. Subsequently, by manually using the knob 34*f* of the flange 34*b* on the cartridge 34, it is inserted, while removing the sealing member by relatively pulling it, into the developer receptacle 22 with the opening 34*d* thereof faced upwardly while respectively aligning the protrusions 35 and 36 on the cartridge 34 with the recesses 24" and 25' of the covering 23 and thus the grooves 28 and 29 of the development receptacle 22 as shown in FIG. 4. The cartridge 34 is fully moved inwardly until the flange 34*b* engages the cover 23, which, therefore, serves as a stopper for the cartridge in the direction B.

Figure 6:
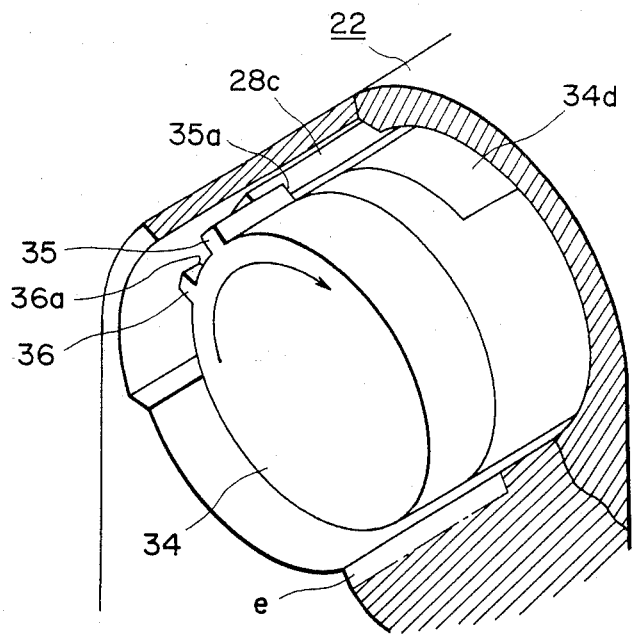
FIGS. 6 and 7 are perspecive views showing the insertion of the developer cartridge into the developing device as viewed backwardly of the developer.

FIG. 6 shows such a state as viewed from the rearward end of the cartridge. As described above, the side 28*c* of the groove 28 is longer than the side 28*a* of the same. The length of the side 28*c* is such that the terminal end of the side 28*c* will be substantially at the midway between the end face 35*a* of the longer protrusion 35 and the end face 36*a* of the shorter protrusion 36 on the cartridge 34. This is because the cartridge can be rotated only in the direction of arrow to supply the developer therefrom to the developer receptacle after the cartridge has been inserted thereinto. The rearward end of the development receptacle has the inner diameter permitting the above protrusions to move in the rotational direction as shown in FIG. 6.

Figure 7:
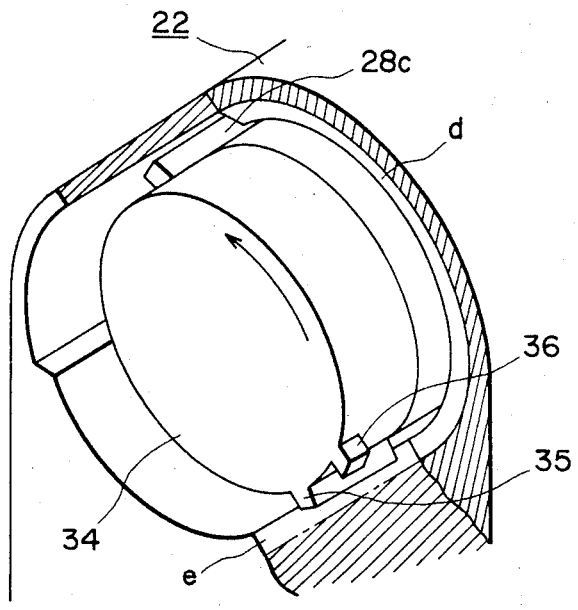

After the cartridge 34 has been inserted into the developing device and if the cartridge 34 is rotated counterclockwise (clockwise as viewed in FIG. 6) with respect to the direction B in which the cartridge is inserted into the developer receptacle, the protrusion 35 will be engaged by the stopper surface e to stop the rotation of the cartridge 34 through the angle of about 180 degrees. At this time, the opening 34*d* of the cartridge 34 will be faced downwardly to align with the developer supply port (not shown) of the developer receptacle so that the developer will be supplied to the developer receptacle through the opening 34*d* of the cartridge 34 (see FIG. 7).

The cartridge 34 is made removable from the developing device by rotating the cartridge 34 in the opposite direction (counterclockwise relative to the plane of FIG. 7) until the protrusion 35 of the cartridge 34 engages the side face 28*c* of the groove 28 (see FIG. 6). The cartridge 34 then may easily be drawn out of the developing device. At this time, the opening 34*d* of the cartridge 34 is faced upwardly so that any remaining developer will not leak out of the cartridge. While the cartridge is inserted into or removed from the developing device, the shorter protrusion 36 of the cartridge 34 will not be obstructed so that nothing will interfere with the rotation of the cartridge. This is true of the other protrusions on the cartridges for blue, magenta and other colors. Even when the cartridge 32 of FIG. 3 containing the black-colored developer is mounted in the corresponding developer receptacle, the limitation of rotation on the cartridge can similarly be effected by the protrusion 33 thereon engaging the side 28*c* of the groove 28 and the stopper surface e.

Figure 8:
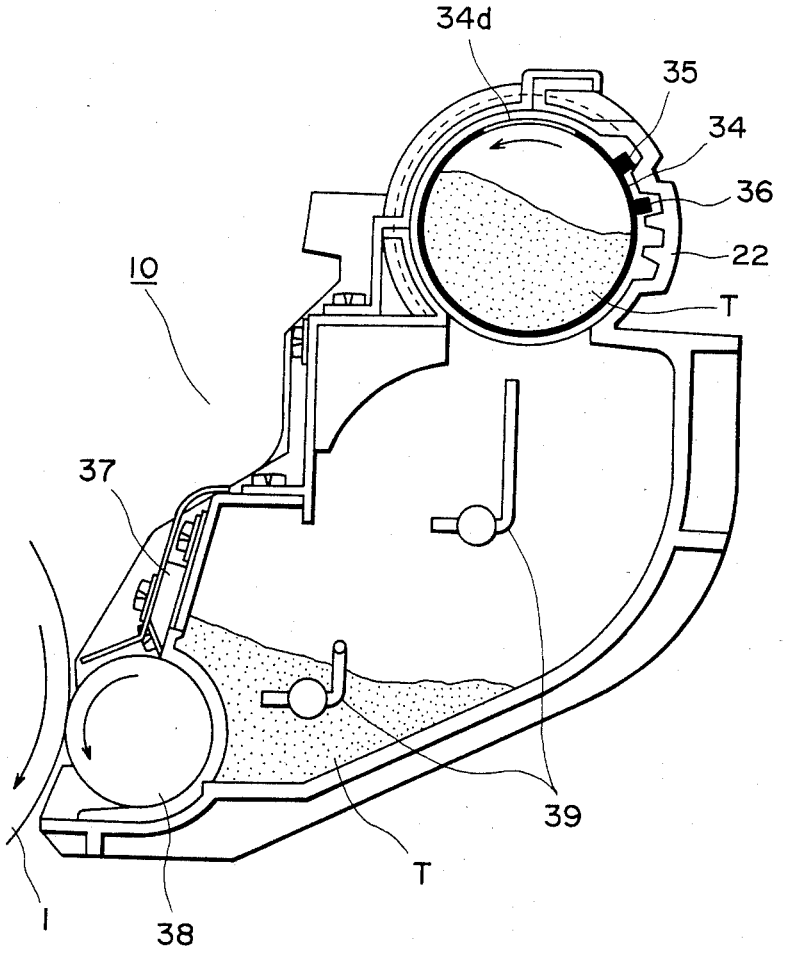
FIGS. 8 and 9 are cross-sectional views of the entire developing device.
Figure 9:
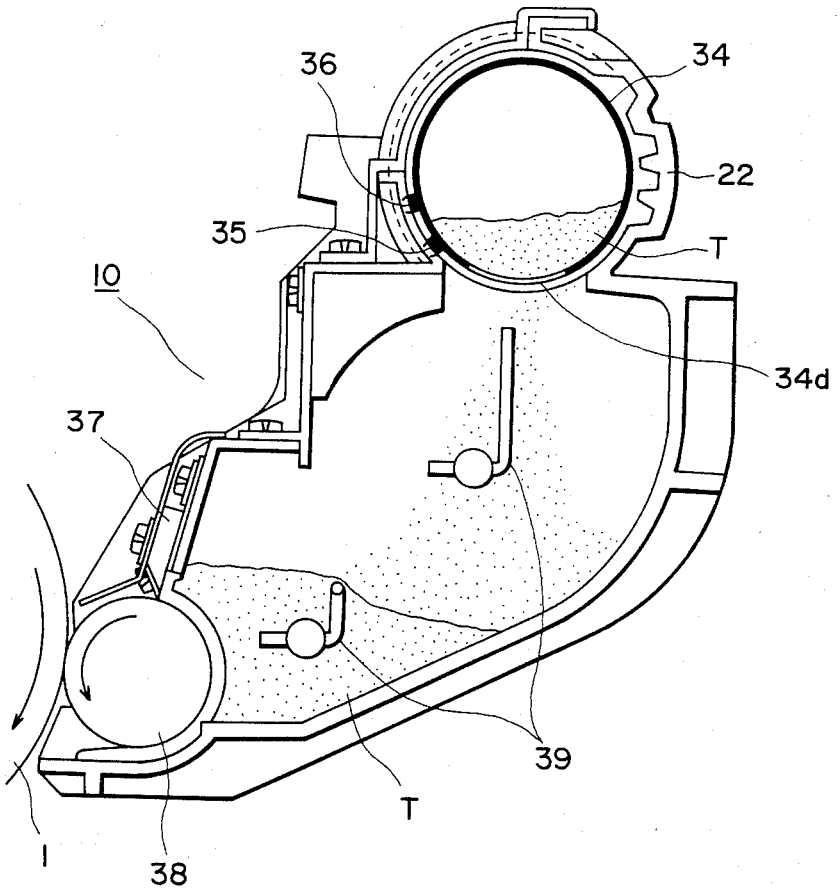

FIGS. 8 and 9 are cross-sectional views of the entire developing device, showing the engagement of the developer cartridge with the developer receptacle which has been described with reference to FIGS. 4 through 7. FIGS. 8 and 9 depict the photosensitive drum or latent image bearing member 1, a blade 37 for controlling the thickness of the developer layer, a development sleeve or developer carrying means 38 for supplying the developer T onto the photosensitive drum 1 to develop the latent image, the sleeve including a magnetic member located therein, and an agitator rod 39 for agitating the developer T.

FIG. 8 shows the developer cartridge 34 inserted into the developer receptacle 22. If the cartridge 34 is rotated from such a condition as shown in FIG. 8 through about 180 degrees in the direction of arrow, the opening 34*d* of the cartridge 34 will be faced downwardly to supply to the developer receptacle 22 therethrough as shown in FIG. 9. The supplied developer T is then agitated to mix in the developer previously supplied in the developer receptacle by means of the agitating rod 39. The developer carrying means 38 supports and moves the developer T in the direction of arrow. During this, the layer of the developer T is controlled in thickness by the blade 37. Thereafter, the developer T is used to develop the latent image on the photosensitive drum 1.

Figure 10:
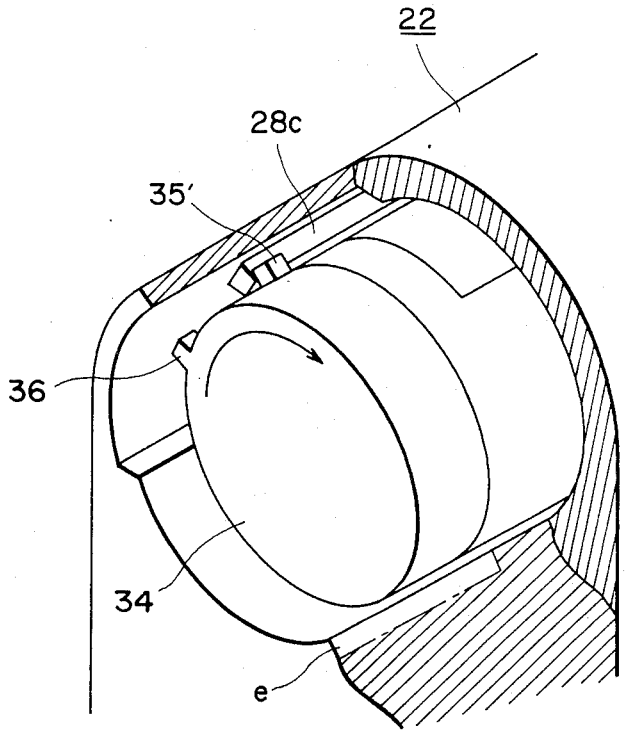
FIG. 10 is a view showing protrusions of the developer cartridge.

Although the previous embodiments have been described as to the positioning protrusion on each of the cartridges which has its length larger than that of the other protrusion on the same cartridge in the direction of cartridge insertion, a protrusion 35' having the same size as that of the protrusion 36 may be located on the cartridge at a position different from that of the protrusion 36 such that when the cartridge is fully inserted into the developer receptacle, at least the protrusion 35' will be engaged by the side face 28*c* of the groove 28, as shown in FIG. 10. This provides the insertion and removal of the cartridge similar to those of the previously described cartridges.

If the cartridge has been completely inserted into the developing device, that is, when the cartridge has been inserted into the developing device until the forward flange 34*b* thereof is engaged by the covering 23, it is only required that at least part of the positioning protrusion is placed at such a position that it is engaged by the side 28*c* of the groove 28 and that this positioning protrusion is spaced away from the surface d which is used to prevent the cartridge from being drawn out of the developer receptacle. That is, it is only required that both the positioning and color-discriminating protrusions are located at different positions from each other with respect to the direction of cartridge insertion such that the color-discriminating protrusion will not be obstructed.

Since the positioning protrusion is located on the cartridge forwardly of the color-discriminating protrusion with respect to the predetermined direction, the cartridge can always be limited in rotation at the same fixed or positioning protrusion. Thus, it is possible that the opening formed in the cartridge is easily and positively aligned with the developer supply port of the developing receptacle.

Figure 11:
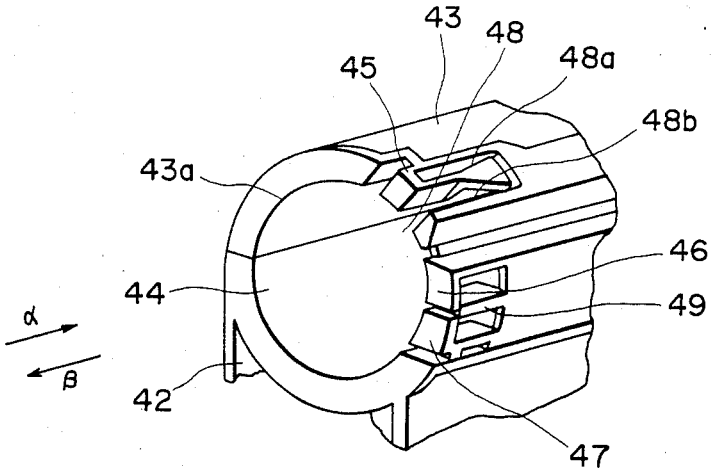
FIG. 11 is a perspective view of another embodiment of the present invention, showing the portion of the developing device into which a developer cartridge is inserted.

FIG. 11 is a perspective view of the cartridge insertion portion of a developing device which is another embodiment of the present invention. In FIG. 11 are shown a developer receptacle 42 and a cap 43 mounted thereon, which define a developer storage receptacle having an opening 44 through which a cartridge is to be inserted into the receptacle. The cap 43 includes an opening 43*a* formed therein which has a plurality of removable stoppers 45, 46 and 47 formed therein along the circumference of the cap and corresponding to the respective developers different in color from one another. The stopper 45 extends longitudinaly of the developer receptacle as shown in FIG. 11. If a force is applied to the stopper 45 in the direction of arrow $\alpha$ or $\beta$, the stopper 45 will be flexed into engagement with the side face 48*a* or 48*b* of a recess 48 such that the stopper 45 will not easily be damaged by the above force. The cartridge will be inserted into the developer receptacle in the direction $\alpha$ and drawn out of the same receptacle in the direction $\beta$. If a force is applied to the stopper 46 or 47 in the direction $\alpha$, it will be flexed into engagement with a dowel 49 on the cap 43 such that the stopper cannot be damaged easily by this force. as in the previous embodiments, a plurality of grooves extend along the length of the cap 43 and are adapted to receive the similar protrusion of the corresponding cartridge when the corresponding stopper is removed from the cap. In addition, means for limiting the rotation of the cartridge and the procedure of inserting and drawing the cartridge are similar to those of the previously described embodiments.

Figure 12:
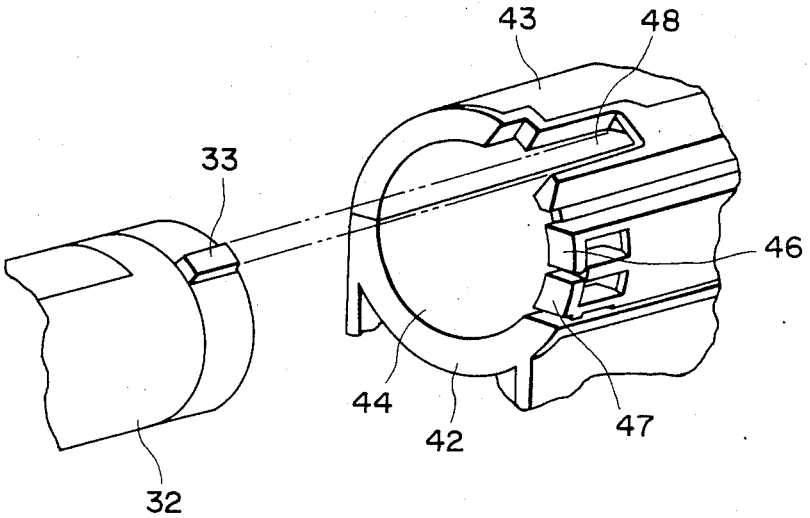
FIGS. 12, 13 and 14 illustrate the engagement of the developer cartridge shown in FIG. 11 with the developing device.
Figure 13:
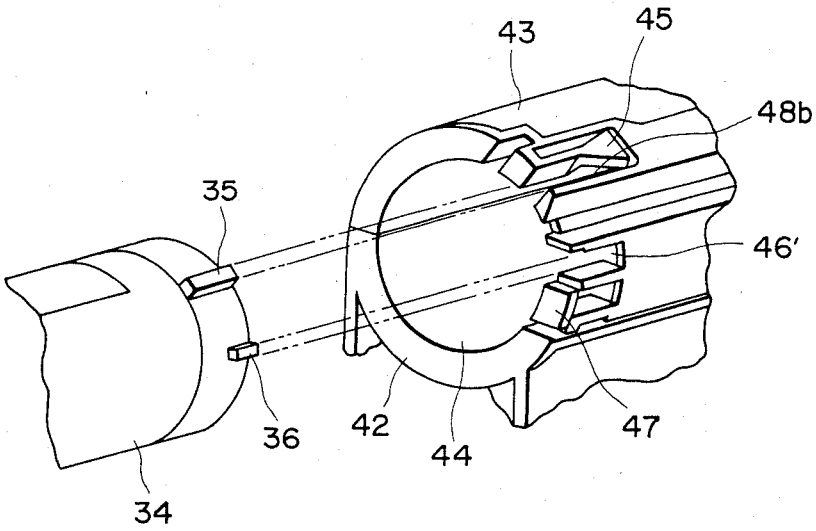
Figure 14:
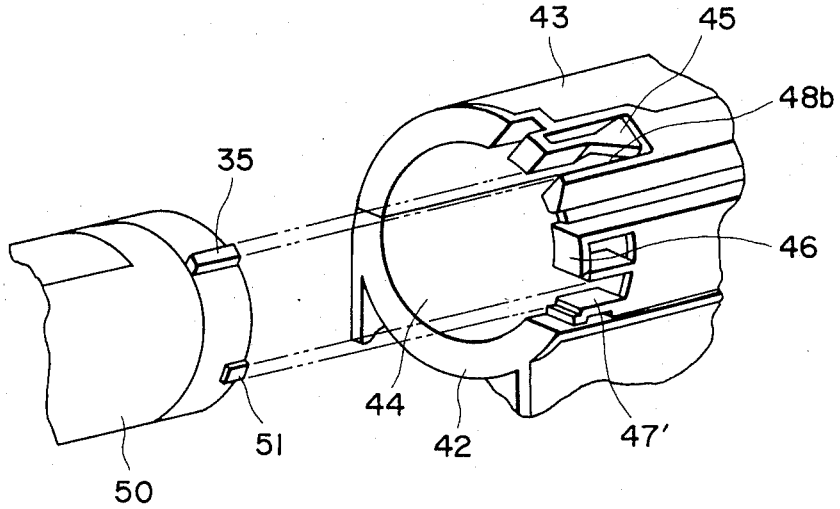

FIGS. 12, 13 and 14 show the relationship between the cartridge and the developing device with respect to different colored developers.

FIG. 12 depicts such a case that the stopper 45 is removed from the cap 43. The cartridge 32 containing, for example, black-colored developer can be inserted into the developing device with the wider protrusion 33 thereon passing through a recess 48 which has been formed by removing the stopper 45.

FIG. 13 shows such a case that the stopper 46 is removed from the cap 43. In this case, a cartridge 34 to be mounted contains, for example, sepia-colored developer and includes a longer protrusion 35 extending longitudinally on the cartridge 34 and a shorter protrusion 36 spaced away from the longer protrusion 35 along the periphery of the cartridge 34. Thus, the cartridge 34 can be inserted into the developing device by passing the protrusion 35 through a recess defined by the stopper 45 and the side face 48*b* of the recess 48 and by passing the other protrusion 36 through a recess 46' formed by removing the stopper 46.

In FIG. 14, the stopper 47 is removed from the cap 43 to form a recess 47'. A cartridge 50 containing, for example, magenta-colored developer includes the same protrusion 35 as in FIG. 13 and a shorter protrusion 51 spaced away from the longer protrusion 35 along the periphery of the cap by a distance larger than that between two protrusions 35 and 36 as in FIG. 13. The cartridge 50 can be inserted into the developing device by passing the longer protrusion 35 through a recess defined by the stopper 45 and the side face 48*b* of the recess 48 and by passing the protrusion 51 through the recess 47'.

In this manner, the cartridge 32 can only be inserted into the developing device shown in FIG. 12; the cartridge 34 can only be inserted into the developing device shown in FIG. 13; and the cartridge 50 can only be inserted into the developing device shown in FIG. 14. Therefore, a wrong cartridge will not be inserted into a developing device.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus loadable with a selected one kind of various kinds of developer containers which contain developers of different colors, respectively, each developer container having a color-discriminating means representative of the color of the developer contained therein, said apparatus comprising:

a developer container receptacle, having a developer container receiving portion which is provided with a receiving opening, for storing the developer supplied from the developer container;

preventing means for preventing insertion of the container into said receptacle by abutment with the color-discriminating means of the container, said preventing means including a plurality of preventing portions which correspond to respective kinds of the developer containers and which are each structured and disposed for preventing insertion of said respective kind of developer container, and said preventing portions being selectively releasable; and developer carrying means for carrying the developer from the developer receptacle toward a latent image bearing member to develop a latent image borne thereon.

2. An apparatus according to claim 1, wherein said preventing portions each include a respective removable preventing member and wherein the insertion-preventing effect of each of said preventing portions is released by removing the respective said preventing member.

3. An apparatus according to claim 2, wherein said preventing members are not easily removed by a force applied in the direction of developer container insertion.

4. An apparatus according to claim 1 or 2, wherein said preventing portion is provided in an opening of a cover of said developer receptacle.

5. An apparatus according to claim 1 or 2, wherein said preventing portion is provided in an opening for allowing the insertion of the developer container.

6. An apparatus according to claim 1 or 2, wherein said developer receptacle is provided with guiding grooves corresponding to the preventing portions, said grooves extending longitudinally of the developer receptacle.

7. A developing apparatus loadable with a developer container which contains a coloring developer, said developer container having a color-discriminating means representative of the color of the developer contained therein, said apparatus comprising:

a receptor portion for receiving only the developer container of a predetermined color; and developing means for receiving the developer from the developer container and developing with the developer a latent image formed on a latent image bearing member;

said receptor portion including a plurality of admitting portions for receiving the developer container for the predetermined color and a plurality of releasable preventing portions, for preventing the insertion of developer containers for the other colors.

8. An appartus according to claim 7, wherein said admitting portion and said preventing portion are provided in an opening of a cover provided at said receptor portion.

9. An apparatus according to claim 7, wherein said admitting portion and said preventing portion are provided at an opening of said receptor portion.

10. An apparatus according to claim 7, wherein said receptor portion is provided with grooves corresponding to said admitting portion and said preventing portion, said grooves extending longitudinally of said receptor portion.

11. An apparatus according to claim 7, wherein said preventing portion is not easily removed by a force given in a direction of the developer container insertion.

12. A developing apparatus loadable with a selected one kind of various kinds of developer containers which contain developers of different colors, respectively, each of the developer containers having a color-discriminating means representative of the color of the developer contained therein, said apparatus comprising:

a developer container receptacle having a container supporting portion capable of supporting any of the developer containers;

limiting means for allowing only the developer container for a predetermined color to be inserted into said supporting portion and for preventing the developer container for another color from being inserted into said supporting portion, said limiting means having an admitting portion for allowing the color-discriminating means provided on the developer container for said predetermined color to pass and a preventing portion for preventing the developer container for another color from entering said container supporting portion by engaging with the color-discriminating means thereof; and developer carrying means for carrying the developer toward a latent image bearing member to develop a latent image carried thereon.

13. An apparatus according to claim 12, further comprising a cover provided at an insertion opening of said supporting portion, and wherein said admitting portion and said preventing portion are provided on said cover.

14. An apparatus according to claim 12, wherein said supporting portion is provided with grooves and said grooves define said admitting portions and said preventing portions, said grooves extending longitudinally of said receptor portion.

* * * * *

UNITED STATES PATENT AND TRADEMARK OFFICE

CERTIFICATE OF CORRECTION

PATENT NO. : 4,611,899

DATED : September 16, 1986

INVENTOR(S) : TOSHIROU KASAMURA, ET AL.

It is certified that error appears in the above-identified patent and that said Letters Patent is hereby corrected as shown below:

COLUMN 2

Line 4, "perspecive" should read --perspective--.
Line 65, "dicharged" should read --discharged--.

COLUMN 3

Line 36, "30 are between" should read --30 and between--.
Line 67, "containing" should read --container--.

COLUMN 4

Line 2, "plastics" should read --plastic--.
Line 28, "apredetermined" should read --a predetermined--.

COLUMN 8

Line 7, "longitudinaly" should read --longitudinally--.
Line 18, "force. as" should read --force. As--.
Line 24-25, "draw-ing" should read --withdrawing--.

UNITED STATES PATENT AND TRADEMARK OFFICE

CERTIFICATE OF CORRECTION

PATENT NO. : 4,611,899

DATED : September 16, 1986

INVENTOR(S) : Toshirou Kasamura, et al

It is certified that error appears in the above-identified patent and that said Letters Patent is hereby corrected as shown below:

COLUMN 10

Line 11, "appartus" should read -- apparatus --.

Signed and Sealed this

Seventeenth Day of March, 1987

*Attest:*

DONALD J. QUIGG

*Attesting Officer*

*Commissioner of Patents and Trademarks*